US006394274B1

(12) United States Patent
Cheeseman

(10) Patent No.: US 6,394,274 B1
(45) **Date of Patent: *May 28, 2002**

(54) STACKABLE BAKERY TRAY

(75) Inventor: Robert V. Cheeseman, Webberville, MI (US)

(73) Assignee: Pinckney Molded Plastics, Inc., Howell, MI (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 88 days.

(21) Appl. No.: 09/149,655

(22) Filed: Sep. 8, 1998

Related U.S. Application Data

(60) Provisional application No. 60/097,781, filed on Aug. 25, 1998.

(51) Int. Cl.[7] ..... B65D 21/00

(52) U.S. Cl. ..... 206/511; 206/503; 206/505; 206/507; 206/515; 206/516; 206/518; 206/519

(58) Field of Search ..... 206/203, 427, 206/507, 511, 509, 518, 515, 519, 503, 505, 516; 220/516, DIG. 15

(56) References Cited

U.S. PATENT DOCUMENTS

| | | | | | |
|---|---|---|---|---|---|
| 3,405,810 | A | * | 10/1968 | Rogus | 206/507 X |
| 3,780,905 | A | | 12/1973 | Herolzer | |
| 3,934,724 | A | | 1/1976 | Johnson | |
| 4,000,817 | A | | 1/1977 | Sanders et al. | |
| 4,211,327 | A | | 7/1980 | Stahl et al. | |
| 4,457,433 | A | * | 7/1984 | Wilson | 206/507 X |
| 4,520,928 | A | | 6/1985 | Wilson | |
| 4,523,681 | A | | 6/1985 | Kreeger | |
| 4,577,759 | A | | 3/1986 | Kreeger | |
| 4,842,142 | A | | 6/1989 | Kreeger | |
| 4,905,833 | A | | 3/1990 | Kreeger et al. | |
| 4,960,207 | A | | 10/1990 | Tabler et al. | |
| 5,035,326 | A | | 7/1991 | Stahl | |
| 5,287,966 | A | | 2/1994 | Stahl | |
| 5,372,257 | A | | 12/1994 | Beauchamp et al. | |
| 5,881,902 | A | * | 3/1999 | Ackermann | 206/509 |
| 6,273,259 | B1 | * | 8/2001 | Stahl | 206/511 |

* cited by examiner

*Primary Examiner*—Stephen P. Garbe
*Assistant Examiner*—Joseph C. Merek
(74) *Attorney, Agent, or Firm*—Young & Basile, P.C.

(57) ABSTRACT

A stackable bakery tray which can be stacked upon an identical bakery tray to provide three levels of storage for bake goods. An identical upper tray can slide on rails of a lower tray when the upper tray and lower tray are each oriented in the same direction and when one tray is orientated 180° from the other tray. Two of the side walls are mirror images of each other and include extending feet and complementary level portions and openings so that extending feet of an upper tray matingly fit within either appropriate level portions or openings of lower tray. End extending feet can pivot within their appropriate level portions or openings to blendly stack and unstack the upper tray to and from the lower tray.

20 Claims, 9 Drawing Sheets

STACKABLE BAKERY TRAY

This application claims benefit of provisional No. 60/097,781 filed Aug. 25, 1998.

FIELD OF THE INVENTION

This invention relates generally to containers and more particularly to bakery trays or baskets which can be nested or stacked.

BACKGROUND OF THE INVENTION

Containers of the nesting and stacking type are well known in the art. In the bakery industry, baked goods come in different heights and sizes, such as hamburger buns, loaves of bread and cakes. It is therefore desirable to provide a stackable tray that accommodates the varying sizes of the baked goods. A number of multi-level stacking trays have been developed. Some of the stacking trays of the prior art do not provide an easy means of aligning an upper tray to a lower tray. Further, some of the stacking trays of the prior art do not provide a means to slide an upper tray onto a lower tray, but instead require a vertical overhead stacking procedure in order to gain the stacking benefit.

U.S. Pat. No. 5,287,966, issued to Stahl, discloses a slidable multi-level basket. This disclosure provides identical trays/baskets stacked at one level when in a common orientation, while configured for sliding and nesting at a second level when one of the baskets is rotated 180° relative to the other. Once the baskets are nested, the upper basket must be vertically lifted to place the complementary sides within the upper rail of the lower basket. There is no provision for blind unstacking of the trays. This is a disadvantage because it generally requires two hands to lift a basket onto the upper rail, rather than pivoting the upper basket with one hand to slide it to the upper rail so that it may be further slid away from the lower tray. Removing the upper basket from the lower basket when the stack is over the head of the user can be almost impossible. The capability of blind stacking and unstacking also provides an advantage in limited height areas where space is not available to physically and vertically lift the upper basket away from the lower basket.

SUMMARY OF THE INVENTION

The present invention addresses the aforementioned problems. In particular, improvement of the invention includes the configuration in the anchoring of the opposite side wall of the tray which is not lifted during the pivoting operation. Thus, the side walls of the bakery tray provide feet and recesses to accommodate both a high and low stacking positions. The opposite ends of the side walls of the bakery tray have complementary feet and recessed orientations, wherein the left end of the side wall has a recess corresponding vertically to a foot, while the right end of the side wall has a second recess vertically corresponding with the second foot. If another tray having the same configuration is stacked in vertical alignment with the first tray, the vertically aligned feet of the upper tray will be received within the first level recesses of the lower bakery tray. This will provide for a higher stacked position or a larger vertical space between the two similarly stacked trays.

When one of the trays is rotated 180° with respect to another tray, a lower level stacked position is created such that a smaller vertical space is created between the stacked trays. The feet on opposite ends of the side wall are received by the lower set of recesses on opposite sides of the side wall. Therefore, the same feet are utilized to be disposed in either set of recesses in the side walls for providing two levels of stacking.

Additionally, when one side wall of the tray is lifted to perform blind unstacking of the tray, the feet of the upper tray pivot and remain within the recesses of the side wall of a lower tray to insure that the upper tray remains stationary when lifting one side of the bakery tray.

Other objects, advantages and applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DESCRIPTION OF THE PREFERRED EMBODIMENT

Figure 1:
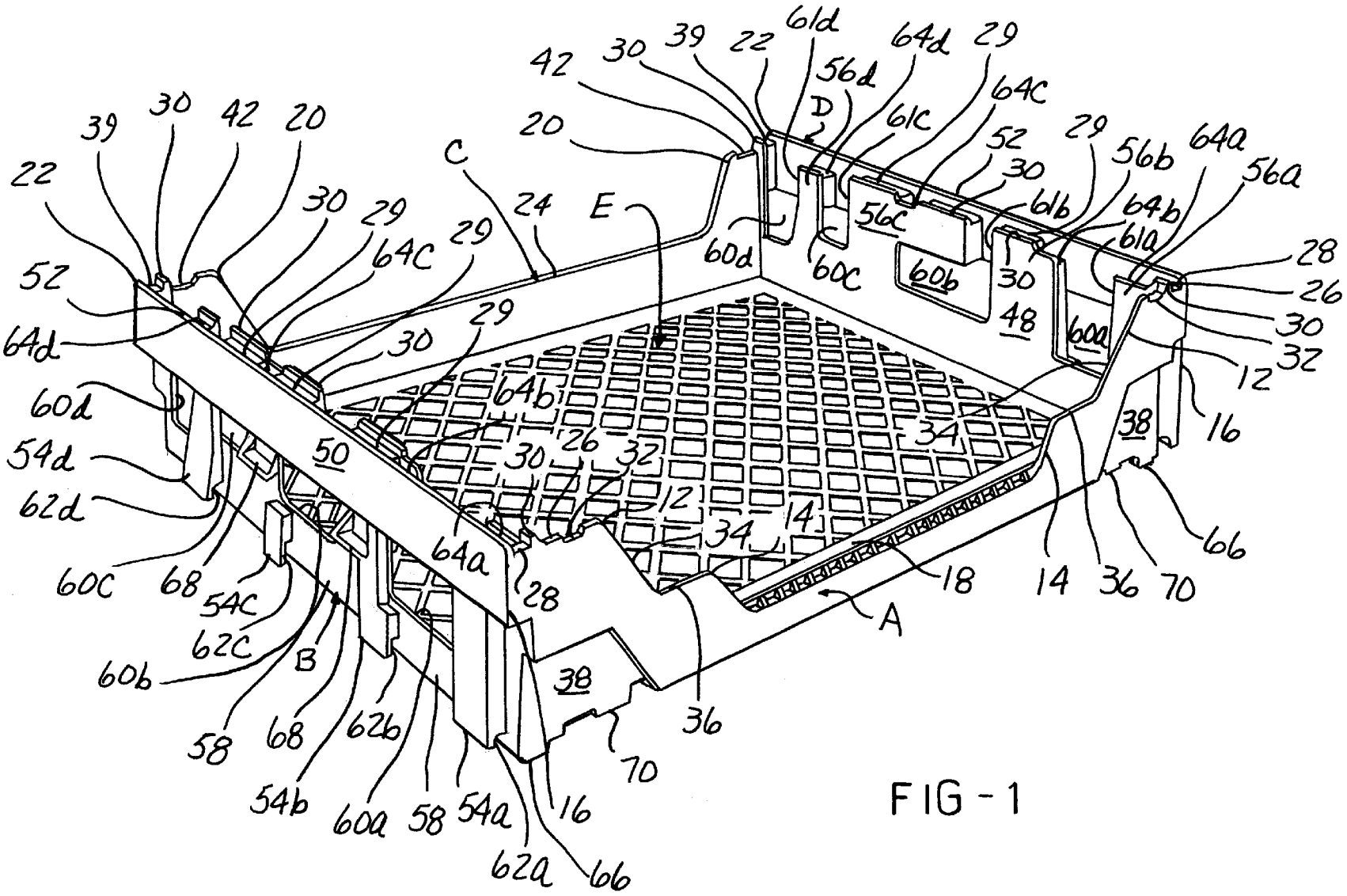
FIG. 1 is a top perspective view of a multi-level tray according to the present invention.

Referring to the drawings, a multi-level basket is shown in FIG. 1. The terms "basket" or "tray" will be used throughout the specification interchangeably to refer to the invention. The bakery tray 10 has four vertical sides and a lower planar surface connected between the four vertical sides. The four vertical sides include a front side referred to as side A, a left side referred to as side B, a back or rear side referred to as side C and a right side referred to as side D as designated in FIG. 1. The lower planar surface is designated as side E in FIG. 1. Sides B and D are mirror images of each other and, therefore, only one side will be discussed. The bakery tray 10, and especially sides B and D of the tray, is configured so that another identical bakery tray 10 may slide above the first bakery tray 10 along a rail, as will be discussed further, until extending portions located on each side B and D fall into a locking position into the first tray 10. If a second tray is positioned in a stacked position such that the front side (A side) of a second tray is facing in the same direction as the first tray, the height between the two planar surfaces (E) of the two trays will be at one level. If a second tray is reversed such that the C side of the second tray is facing the same direction as the A side of the lower tray in a stacked position, the height between the two planar surfaces of the two trays will be at a different level. Therefore, different size baked goods can be stored by utilizing the most space saving configuration of the bakery trays. As will be seen, the trays may also be orientated 90° relative to each other (FIG. 14) for a third level spacing. The invention further provides a blind stacking and unstacking feature that accommodates the storage and stacking of additional trays at a height over the head of an individual.

Figure 8:
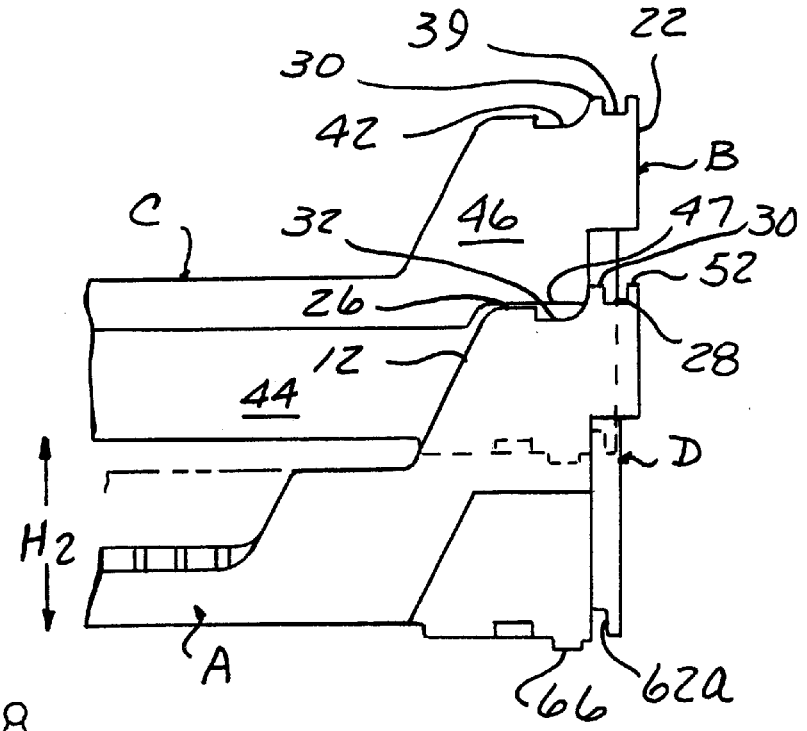
FIG. 8 is a partial front elevational view of the lower basket and a partial rear elevational view of the upper basket in the nested position.
Figure 9:
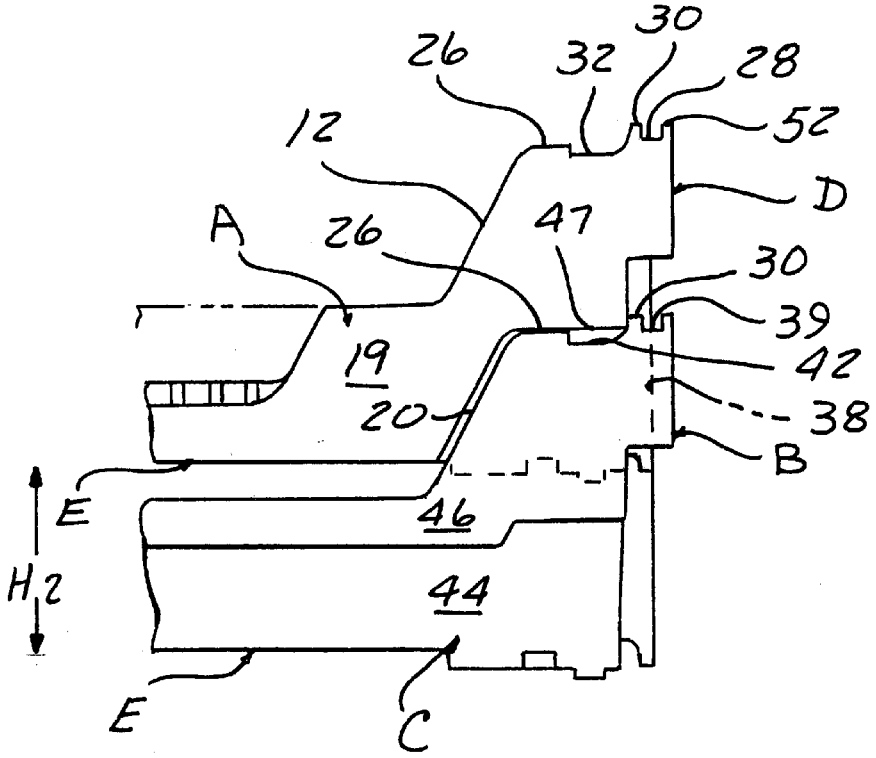
FIG. 9 is a partial rear elevational view of a lower basket and a partial front elevational view of the upper basket in a nesting position.
Figure 14:
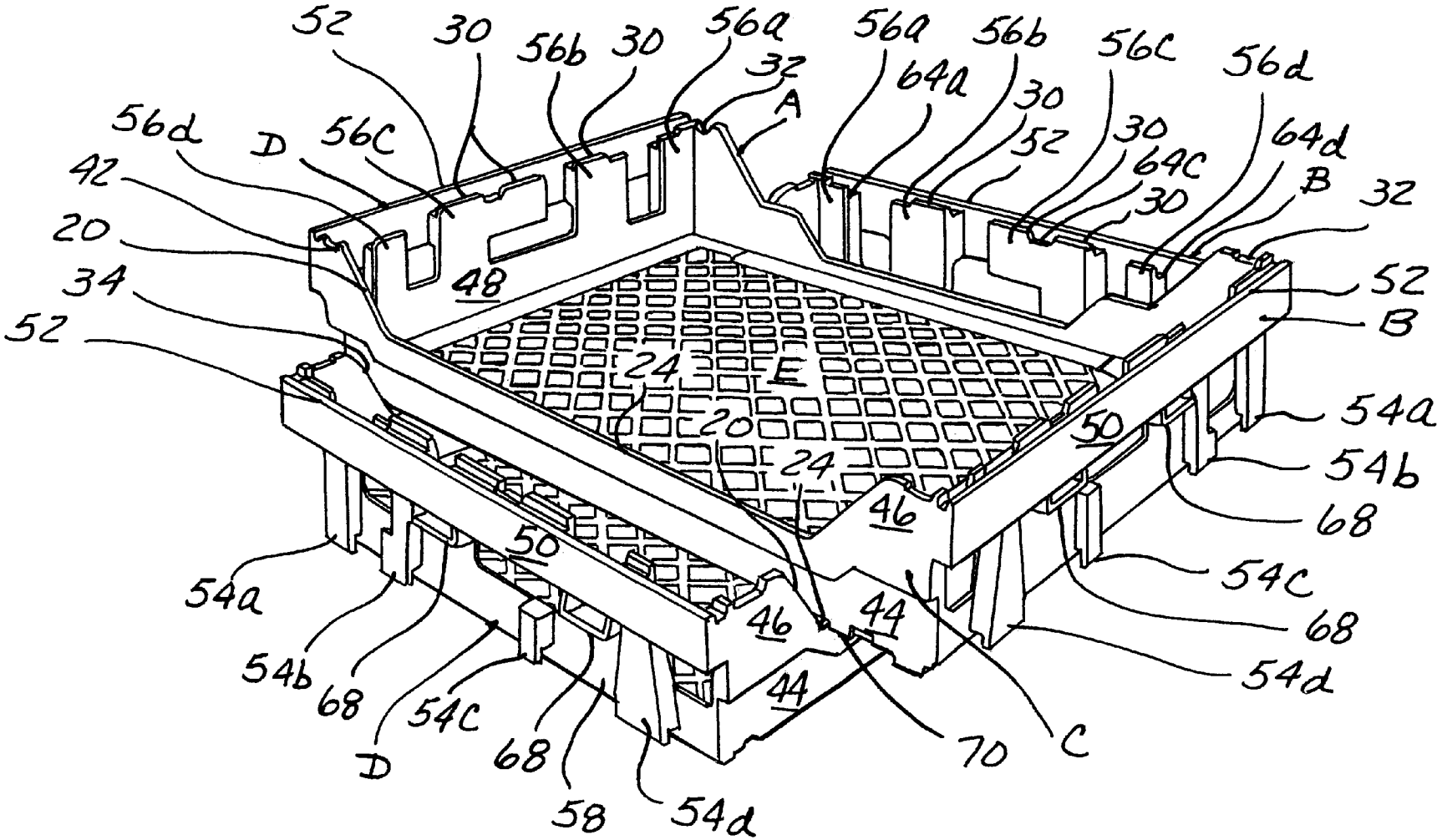
FIG. 14 is a perspective view of nesting baskets where the upper basket is rotated 90° relative to the lower basket.

The bakery tray will be described as referring to FIG. 1. The bakery tray or bread basket 10 is a unitary molded plastic tray having four walls (A, B, C and D) and a lower planar floor surface E. The lower floor surface E may be a solid floor or preferably perforated or cross-hatched as shown in FIG. 1 to provide ventilation between the layers of bakery goods. The perforated floor E also provides finger grips for blind stacking and unstacking of the trays 10. The front and rear sides, referred also as side A and C respectively, have lower heights than side walls B and D. The front wall (side A) has a two step angular portions 12 and 14, respectively, at each corner 16 with a lower ledge 18 therebetween. The rear wall (side C) has a single step angular portion 20 at each corner 22 with a lower ledge 24 therebetween. On the upper essentially horizontal surface 26 of the upper step 12 of side A, and adjacent to each side wall (B and D) is a rectangular notch 28 and a first rail lip portion 30 which commences the non-continuous rail 29 for guidance along the side walls (B and D) when stacking an upper tray over the current lower tray. Adjacent the first rail lip 30 of the side of wall A and inboard from the side walls (B and D) is a second notch 32. Each second notch 32 is sized to accommodate one of the side walls (B and D) when an upper tray is positioned 90° relative onto the lower tray, as shown in FIG. 14. The angular surfaces 34 of the first step 12 on either end of front wall (A) are spaced from each other to maintain an upper tray in a 90° position. The upper horizontal surface 36 of the second step of wall (A) is at the same height as the center ledge portion 24 of wall (C). Below each first step portion 12 on wall (A) is an angular cut-out portion 38 made into the exterior surface 19 of wall (A) so that the upper tray may drop behind the first step portion or angular ledge portion 12 and 20 of wall (A) or (C) respectively of the lower tray. This feature is shown in FIGS. 8 and 9.

The rear wall (C), as shown more clearly in the upper tray in FIG. 14 has similar notch formations on the upper wall surface as the front wall. Therefore, the wall (C) also includes a first notch portion 39 adjacent to each rail lip portion 30. First notch portion 39 is parallel to first notch portion 28 on side A, and rail lip portion 30 of wall (C) is parallel to rail lip portion 30 on side (A). Next to the rail lip portions 30 is a second notch 42 which is parallel to second notch 32 on side (A). The outer surface 46 of rear wall (C) has a lower portion 44 that is recessed which slides behind the upper portion 46 of rear wall (C) of a lower basket or behind exterior surface 19 of front wall (A), as shown in FIG. 8.

As discusses supra, the side walls of the bakery tray 10, referred to as sides (B) and (D), are mirror images of each other. Therefore, looking at FIG. 1, side wall (D) will be discussed when detailing the inner surfaces 48 of the wall, and side wall (B) will be discussed when detailing the outer surfaces 50 of the side wall. An upper continuous wall portion extends the entire length of side walls (B and D), herein referred to as the outer rail guide 52. The two outer rail guides 52 are integral with the front and rear walls (A and C, respectively). The outer rail guide 52 and rail lip portion 30 are the lateral boundaries of rail 29. Notches 28 and 39 are beginning and ending portions of rail 29.

Looking at the B side of FIG. 1 of the bakery tray 10, and extending below the outer rail guide 52 are four extending feet 54*a*, 54*b*, 54*c*, 54*d* which extend vertically downward to the floor portion (E) of the tray 10. The four extending feet 54*a*, 54*b*, 54*c*, 54*d* have different widths and are spaced at nonuniform distances from each other. The extending feet 54*a*, 54*b*, 54*c*, 54*d* are spaced inward of the outer rail guide 52 and are connected to the outer rail guide 52 at their upper legs 56*a*, 56*b*, 56*c*, 56*d* to the inner wall surface of outer rail guide 52. The upper legs 56*a*, 56*b*, 56*c*, 56*d* are spaced from the surface of the outer rail guide by the integrally connected rail portions 29. The extending feet 54*a*, 54*b*, 54*c*, 54*d* are further connected to an exterior inner wall 58 which is integral with the floor (E). The inner wall 58 extends upwardly from the floor only a couple of inches so that there are gaps 60*a*, 60*b*, 60*c*, 60*d* or open spaces between the inner wall 58 and the outer rail guide 52 and the spacing between the upper legs 56*a*, 56*b*, 56*c*, 56*d*. The purposes of the gaps 60*a*, 60*b*, 60*c*, 60*d* will be discussed further. At the bottom of each extending foot 54*a*, 54*b*, 54*c*, 54*d*, there is an inner groove 62*a*, 62*b*, 62*c* and 62*d* respectively, adjacent the inner wall surface 58.

Figure 2:
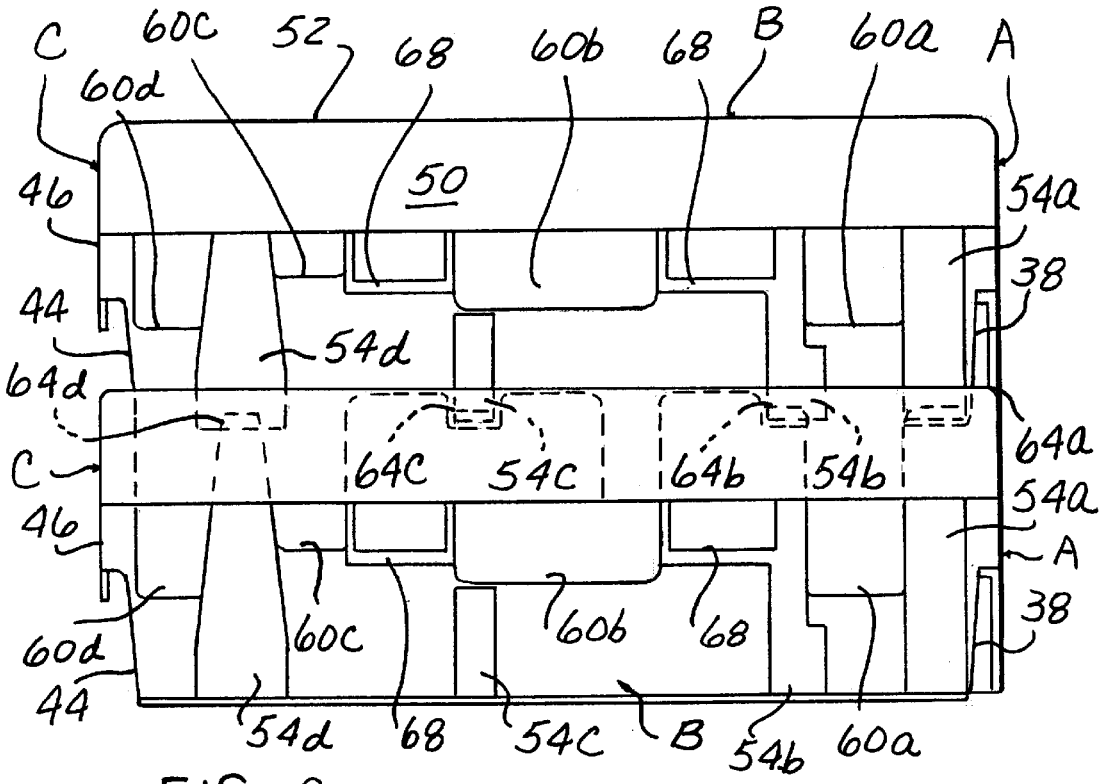
FIG. 2 is a left side elevational view of two multi-level baskets in nested position wherein each basket is facing the same direction.
Figure 3:
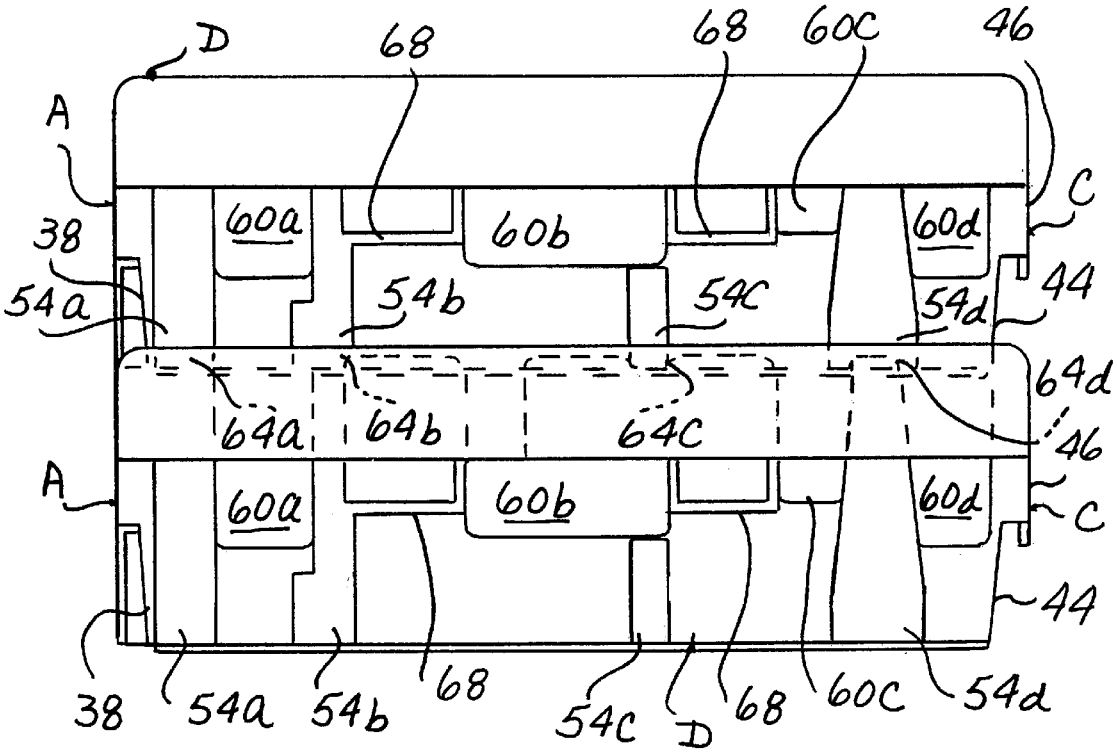
FIG. 3 is a right side elevational view of the two multi-level baskets in nested position wherein each basket is facing the same direction.

Looking at FIG. 1, the left side (D) of the bakery tray displays the inner wall 58 of the side walls. As stated before, side wall (D) is the mirror image of side wall (B). The inner wall 58 is integral with the upward extending legs 56*a*, 56*b*, 56*c*, 56*d* having various shapes with openings 61*a*, 61*b*, 61*c*, 61*d* to respective gaps 60*a*, 60*b*, 60*c*, 60*d*. The upper end of the upwardly extending legs 56*a*, 56*b*, 56*c*, 56*d* terminate at different levels. Each of the upward extending legs 56*a*, 56*b*, 56*c*, 56*d* include a rail lip portion 30 upon which the inner groove 62*a*, 62*b*, 62*c*, 62*d* of the downwardly extending feet 54*a*, 54*b*, 54*c*, 54*d* of an upper basket tray rides thereon. Further, each of the upwardly extending legs 56*a*, 56*b*, 56*c*, 56*d* have portions that terminate at a first level at a position coinciding with the downwardly extending feet 54*a*, 54*b*, 54*c*, 54*d*. The first level portions 64*a*, 64*b*, 64*c*, 64*d* are on the same parallel plane. The first planar level of portions 64*a*, 64*b*, 64*c*, 64*d* is positioned at a level lower than the rail and rail lip 30. The position of the first level accommodates the overhead extending feet 54*a*, 54*b*, 54*c*, 54*d* from an upper bakery tray 10. The first level planar positions 64*a*, 64*b*, 64*c*, 64*d* and lower extending feet positions 54*a*, 54*b*, 54*c*, 54*d* are spaced so that the lower extending feet positions 54*a*, 54*b*, 54*c*, 54*d* do not drop into the first level position 64*a*, 64*b*, 64*c*, 64*d* while traveling on the rail 29 until the upper bakery tray is fully set directly over the lower bakery tray. Then extending foot 54*a* drops into first level portion 64*a*, extending foot 54*b* drops into first level portion 64*b*, extending foot 54*c* drops into first level position 64*c*, and extending foot 54*d* drops into first level portion 64*d*. In FIGS. 1, 2 and 3, there are shown four lower extending feet and four first level positions. Each lower extending foot and first level position is numbered to indicate the correlation between lower extending feet 54*a*, 54*b*, 54*c*, 54*d* and first level positions 64*a*, 64*b*, 64*c*, 64*d*. FIGS. 2 and 3 show the respective lower extending feet on the upper basket tray in the corresponding first level position of the lower tray. FIGS. 2 and 3 also show the alignment of the lower extending feet placed in the corresponding and respective first level positions when the upper bakery tray 10 is placed in the same direction as the lower bakery tray 10, that is, the front side (side A) is facing the same direction for both the upper and lower bakery trays.

Figure 6:
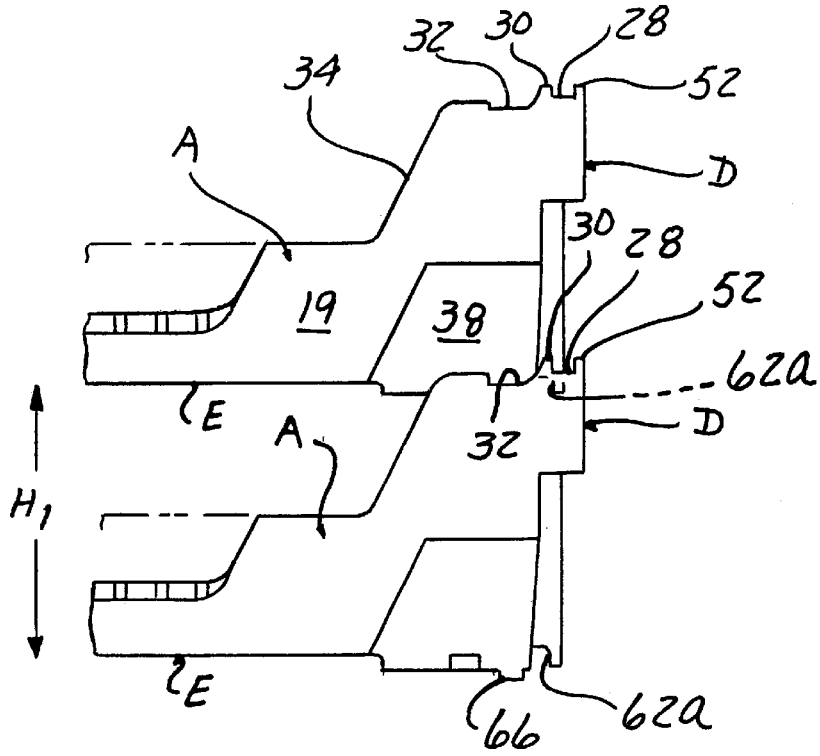
FIG. 6 is a partial front elevational view of the two nesting baskets at a corner.
Figure 7:
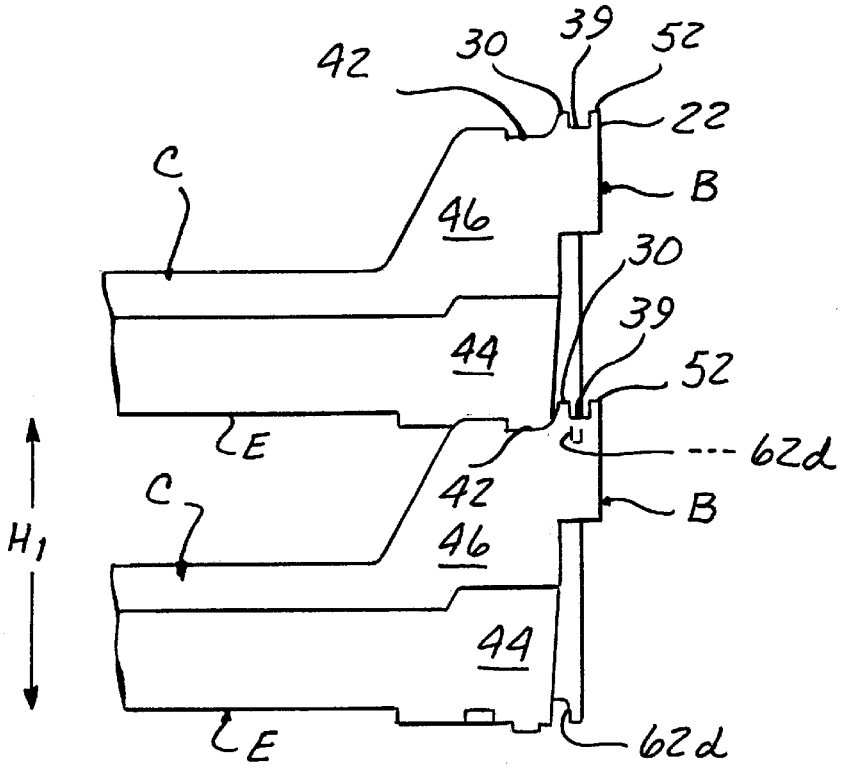
FIG. 7 is a partial rear elevational view of the two nesting baskets at a corner.

FIGS. 6 and 7 show portions of the front and rear sides (A and C) of two stacked baskets 10 respectively. The portions shown are located at a corner to illustrate how the corners of an upper and lower basket meet when in the stacked position. As can be seen in FIG. 6, the inner groove 62 receives the first rail lip 30 so that extending foot 54*a* is positioned to be behind the first notch portion 28 and in first level position 54*a*. Further, the second notch portion 32 receives a complementary size flange 66 extending from the floor E of the upper tray. Cut-out portion 38 of the upper tray sets behind first step portion 12 of the lower tray. In FIG. 7, inner groove 62*d* slides in rail 29. The interrelationship between the surfaces help to provide stability for stacked trays. As further can be seen in FIGS. 6 and 7, the space or height distance between floors E of the lower tray to the upper tray is shown as H1. When two or more trays are stacked in the same direction, the open areas or gaps 60*a*, 60*b*, 60*c*, 60*d* are provided for air circulation as well as areas to insert one's hand for carrying the stack of trays.

Figure 4:
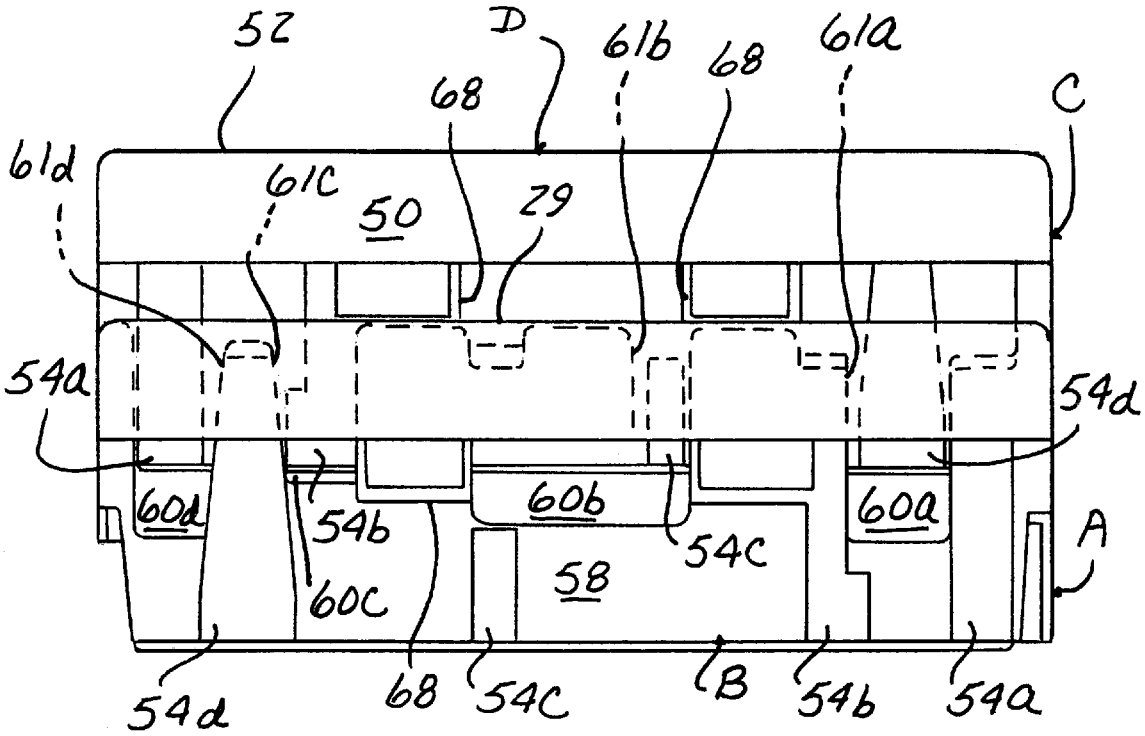
FIG. 4 is a left side elevational view of the lower basket and the upper basket in the nested position wherein the upper basket is turned 180° relative to the lower basket.
Figure 5:
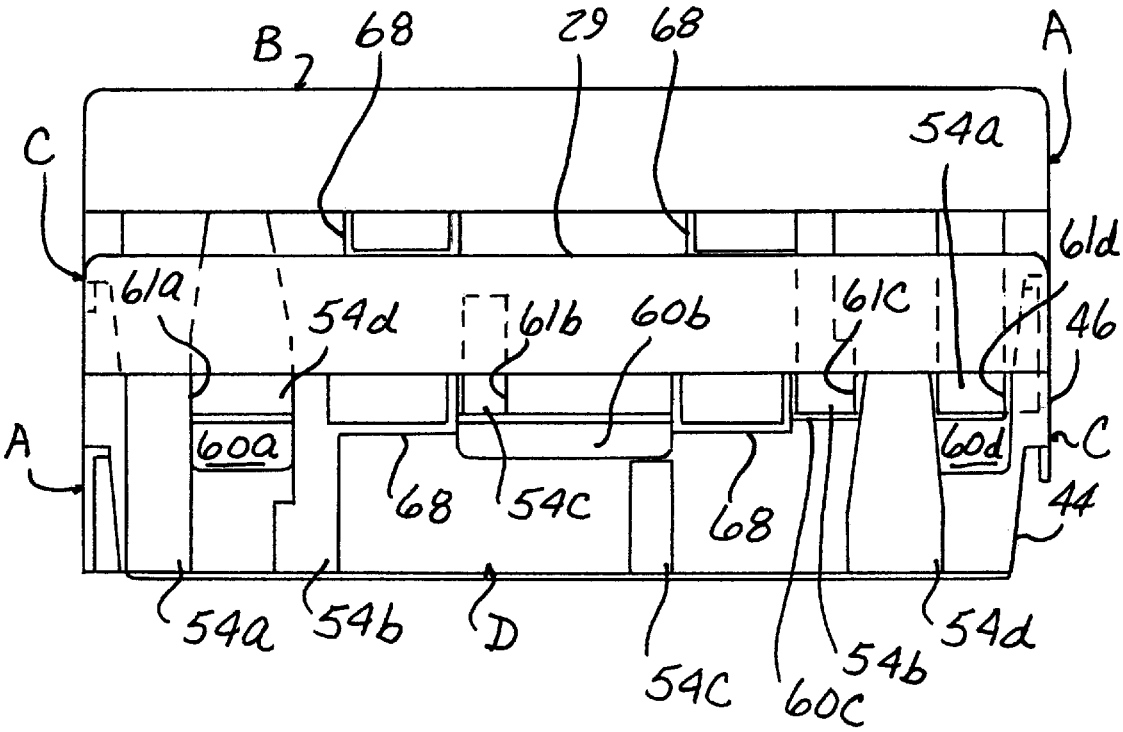
FIG. 5 is a right side elevational view of the lower basket and the upper basket in the nested position wherein the upper basket is turned 180° relative to the lower basket.

When the upper tray is turned 180° relative to the lower tray the relationship of two stacked trays is as illustrated in FIGS. 4, 5, 8 and 9. FIG. 4 illustrates a front elevational view of left side (B) of the bakery tray as the lower tray and the right side (D) of the upper tray. When the upper tray is reversed 180° relative to the lower tray the extending feet 54*a*, 54*b*, 54*c* and 54*d* of the upper tray will still ride along the rail 29 until the upper tray is completely directly over the lower tray. When the upper tray is completely over the lower tray, the extending feet 54*a*, 54*b*, 54*c* and 54*d* are configured and spaced so that they drop into the openings 61*a*, 61*b*, 61*c*, 61*d* to the gaps 60*a*, 60*b*, 60*c*, 60*d* respectively between the rail portions. The feet and recess orientation is such that the feet do not drop into any level positions or openings to gaps until completely over a lower tray. In FIG. 4, extending foot 54*a* drops into opening 61*d*, extending foot 54*b* drops into opening 61*c*, extending foot 54*c* drops into opening 61*b*, and extending foot 54*d* drops into opening 61*a*. When the top bakery tray is directly over the bottom bakery tray a pair of shelves 68 located on both sides (B and D) of the bakery basket rest on rail lip portion 30. The rail lip 30 act as a stop for the shelves 68 for determining the height of the upper basket relative to the lower basket. Likewise, looking at the opposite sides of the stacked bakery trays as shown in FIG. 5, the left side (B) is directly over the right side (D). FIG. 5 shows that the pair of shelves 68 rest on the rail lip portion 30 and also the relationship of the extending feet 54*a*, 54*b*, 54*c*, 54*d* in openings 61*a*, 61*b*, 61*c*, 61*d*.

FIGS. 8 and 9 show front and rear views of corner portions of stacked trays where one of the trays are 180° reversed relative to the other tray. In FIG. 8 the front face (A) is in view for the lower tray and the rear face (C) is in view for the upper tray. As can be seen in FIG. 8, the lower recessed portion of the rear wall (C) slides directly behind the first step portion 12 of the front wall (A). A bottom surface portion 47 of the upper portion 46 of the rear wall (C) sets upon the upper horizontal surface 26. Looking at FIG. 9, the front wall (A) of the tray 10 is in view as the upper bakery tray 10 while the rear face or wall (C) is in view for the lower bakery tray. When the trays in this configuration are in a stacked position, the front cut out portion 38 of the front face (A) slides behind the upper portion 46 of the rear wall (C). When comparing the height (H1) between floors (E) of the upper bakery tray to the lower bakery tray when one of the trays is 180° reversed relative to the other bakery tray the height differential (H1) is less than the height differential (H1) when the trays are facing the same direction, as shown in FIGS. 6 and 7.

Figure 10:
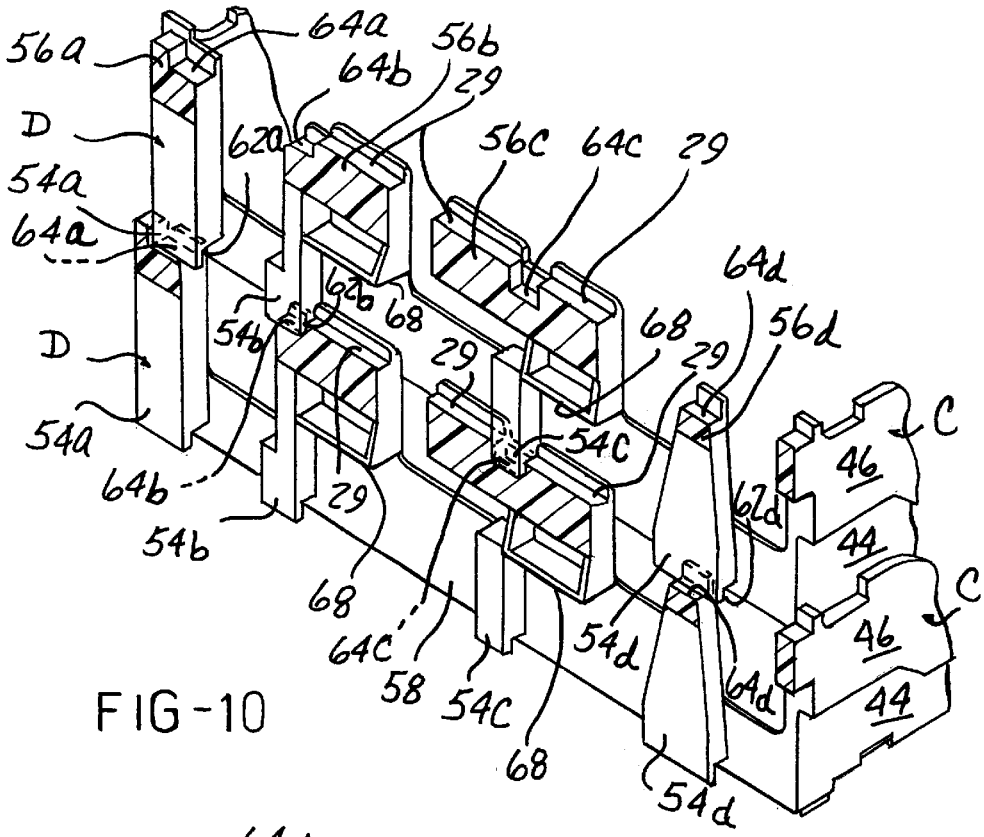
FIG. 10 is a partial perspective view of two nested baskets facing the same direction.
Figure 11:
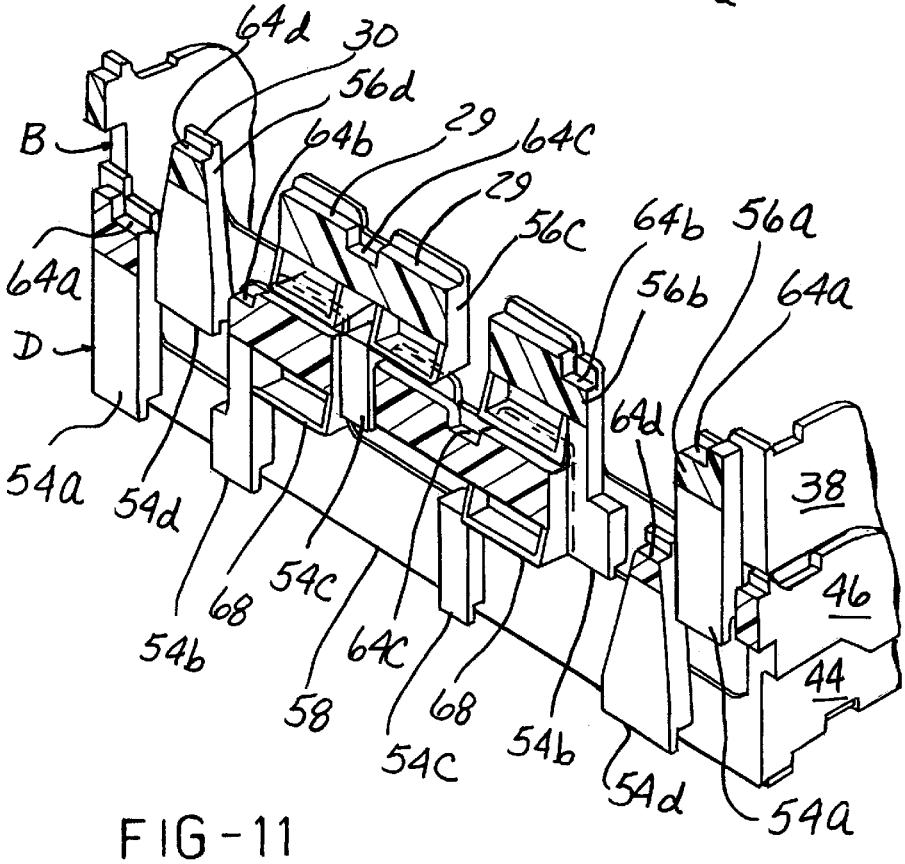
FIG. 11 is a partial perspective view of two nesting baskets having the upper nesting basket rotated 180°.

FIGS. 10 shows a perspective view of FIG. 3 wherein the outer rail guide is cut away so that views of the stacking mode are better seen. FIG. 10 shows the bakery trays stacked in the same direction with right side (D) in view. FIG. 11 shows a perspective view of FIG. 2 wherein one tray is 180° reversed relative to the other tray. Left side (B) is in view for the upper tray and right side (D) is in view for the lower tray. The extending feet 54*a*, 54*b*, 54*c*, 54*d* are shown in relationship with the first level portions 64*a*, 64*b*, 64*c*, 64*d* and openings 61*a*, 61*b*, 61*c*, 61*d*.

Figure 12:
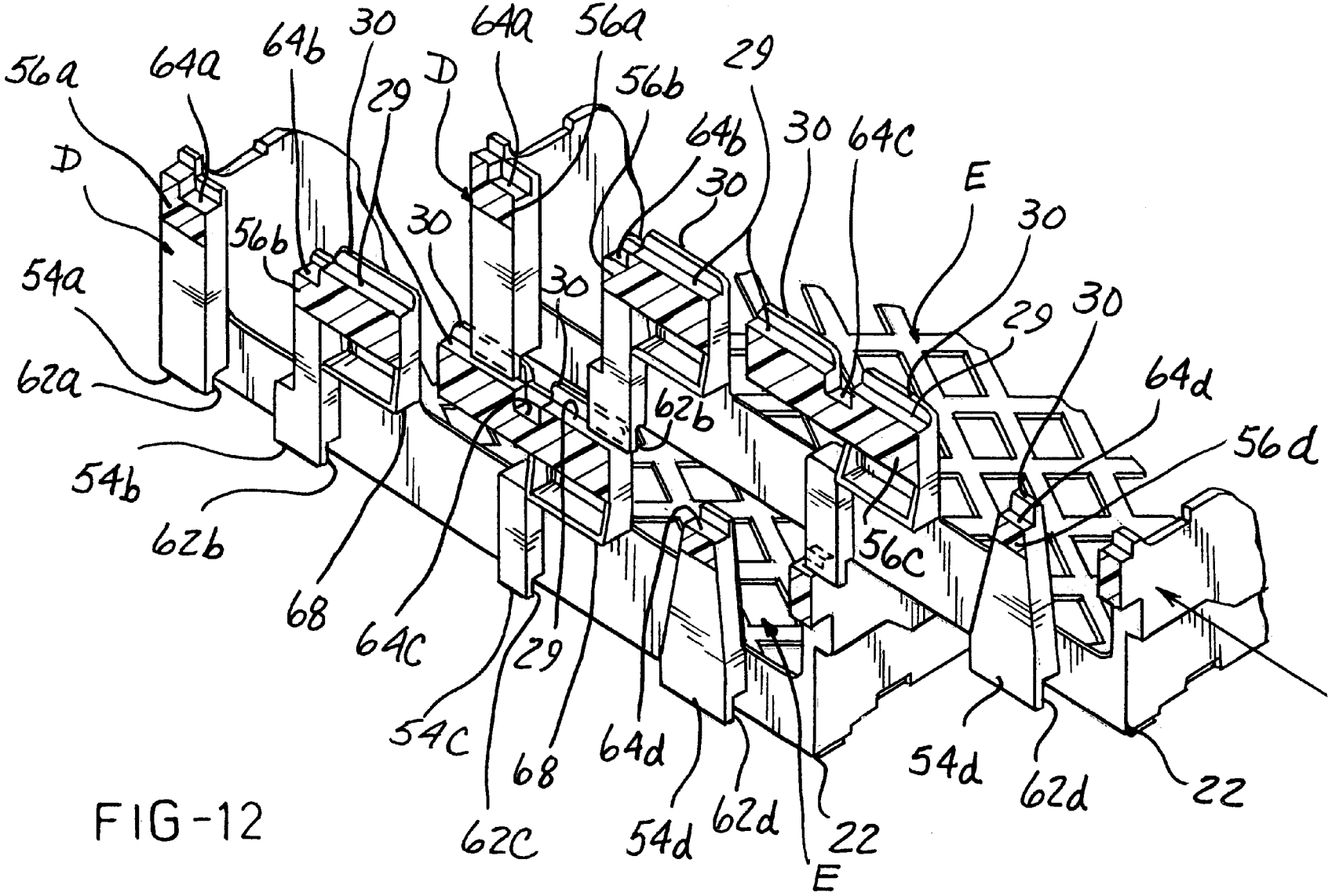
FIG. 12 is a partial perspective view of the upper basket in FIG. 10 sliding along the lower basket.

FIG. 12 is a view of FIG. 10 showing the upper basket tray sliding on the rail portion of the lower bakery tray. As can be seen, the extending feet 54*a*, 54*b*, 54*c* and 54*d* are spaced on the upper tray and the rail portions 30 are spaced on the lower tray such that the extending feet 54*a*, 54*b*, 54*c*, 54*d* do not drop to one of the lower levels until the upper tray is fully stacked over the lower tray.

Figure 13:
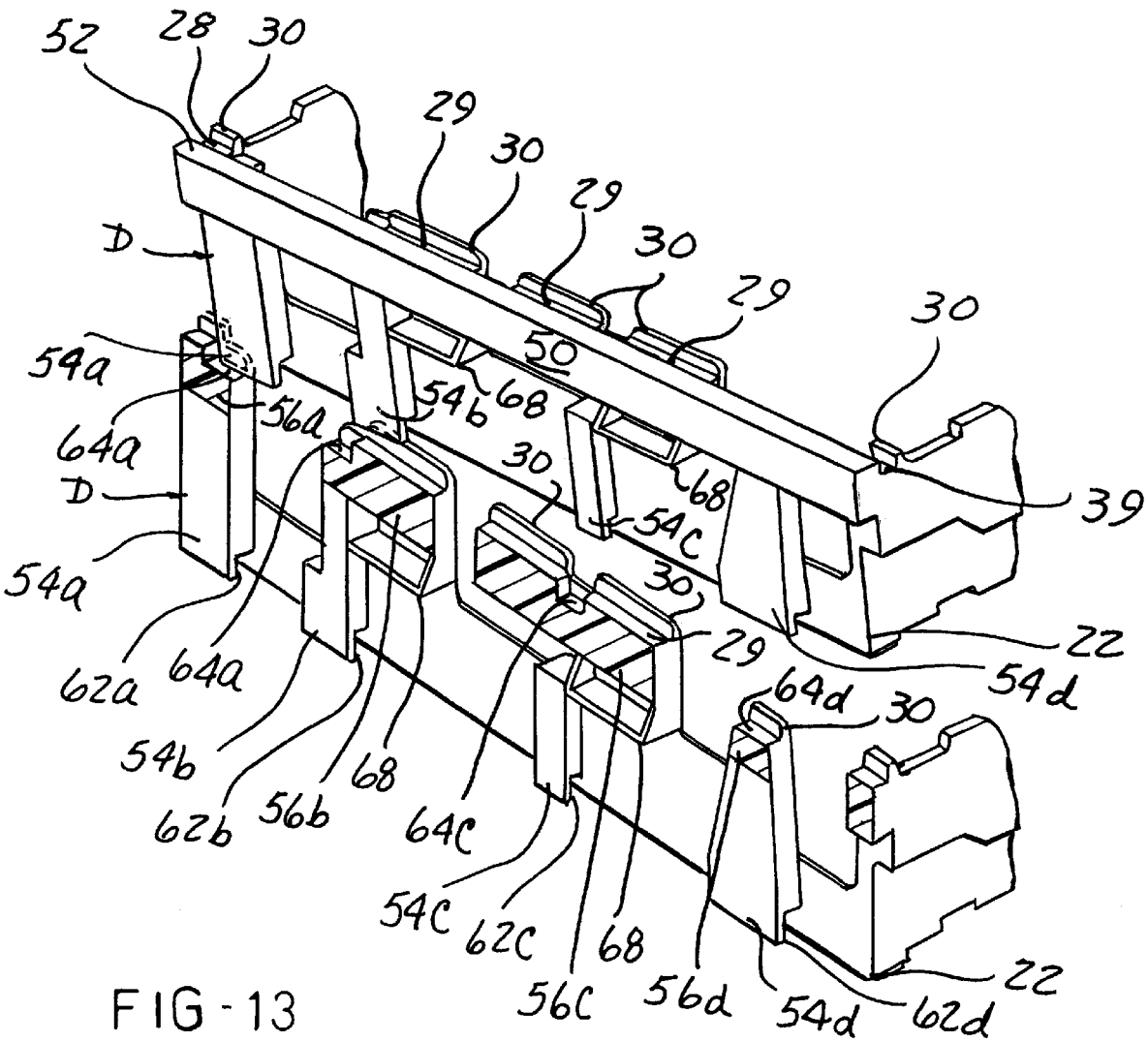
FIG. 13 is a partial cross-sectional perspective view of the blind stacking and unstacking feature of the upper basket relative to the lower basket.

FIG. 13 shows the blind stacking and unstacking feature of the present invention. FIG. 13 is again a view of FIG. 10 showing right sides (D) for both the upper and lower bakery trays. Extending leg 54*a* pivots on its first level portion 64a so that extending feet 54*b*, 54*c*, 54*d* will slightly move forward to be raised onto an adjacent rail portion 29. Once the extending feet are raised onto the rail portions 29, the upper bakery tray may slide along for removal from the lower tray. Extending leg 54*a* can pivot in opening 61*a* also. Although not shown, extending foot 54*d* can also pivot whether located on the first level portion 64*d* or located in an opening 61*a* of a gap area 60*a*. The pivoting feature is provided by the openings 61*a*, 61*b*, 61*c*, 61*d* between the rail portions 29 that gives the extending feet 54*a* and 54*d* room to pivot and be lifted from the first level position or opening to the gap to the rail 29. The widths of the first level positions 64*a*, 64*b*, 64*c*, 64*d* and the widths of the openings 61*a*, 61*b*, 61*c*, 61*d* are larger than the widths of the extending feet 54*a*, 54*b*, 54*c*, 54*d*.

FIG. 14 shows an upper tray turned 90° relative to a lower tray for stacking purposes. The lower edge portions of front and rear sides A and C are disposed between the angular walls 34 and 20 of sides A and C respectively of the lower tray. The upper tray 10 is prevented from movement by inner flange 70 located against the exterior wall surface 19 of front side (A) and upper portion 46 of rear wall (C). This prevents lateral movement of the top or upper tray.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A tray for stacking a plurality of identical trays with respect to one another and providing at least three levels of stacking corresponding to different angular positions of vertically adjacent stacked trays with respect to one another, said tray comprising:

a front wall;

a rear wall opposite from the front wall;

two side walls and a rectangular floor integrally connected to the four walls, wherein said two side walls are mirror images of each other, each side wall having a continuous outer ledge at an upper end of each side wall and a discontinuous inner ledge spaced from the outer ledge forming a discontinuous groove therebetween, each side wall further having a plurality of non-uniformly spaced feet at a lower end providing different stacking levels when two identical trays are stacked vertically at different angular orientations with respect to one another, the front and rear walls having a notch adjacent to each side wall in vertical alignment with the feet and in horizontal alignment with the discontinuous groove providing sliding access to the discontinuous groove by the feet of another tray for stacking, the notch formed as a generally concave indentation with steep opposing sides, wherein a first level of stacking is defined when adjacent stacked trays are aligned in an identical orientation with respect to one another, a second level of stacking is defined when adjacent stacked trays are rotated 90° with respect to one another, and a third level of stacking is defined when adjacent stacked trays are rotated 180° with respect to one another, the feet integrally formed on lower ends of each side wall of the upper tray, and a corresponding number of shaped slots formed in upper ends of each side wall of the lower tray and engageable with respect to the corresponding feet for defining cam surfaces engageable with one another to move the upper tray in a direction toward one of the front and rear walls in response to the one wall being lifted to allow the upper tray to slide with respect to the lower tray for unstacking the upper tray from the lower tray.

2. The tray of claim 1 further comprising the plurality of feet along each side wall each having a different horizontal length and spaced along each side wall at uneven intervals.

3. The tray of claim 1 further comprising the front wall having a pair of angular surfaces and a lower level surface therebetween, wherein said lower level surface on a lower tray supports an upper identical tray oriented 90 degrees relative to the lower tray.

4. The tray of claim 3 further comprising the rear wall meeting each side wall at a corner and said rear wall having downwardly directed flanges proximate to each corner preventing movement of the upper tray when an upper tray is stacked in an angular position rotated 90 degrees relative to the lower tray.

5. The tray of claim 1 further comprising the feet each having an inner groove for sliding over the discontinuous inner ledge.

6. The tray of claim 5 further comprising the side walls having at least two stacking levels.

7. The tray of claim 6 further comprising each side wall including more than one handle means.

8. The tray of claim 7 further comprising the handle means formed by gaps between portions of the discontinuous inner ledge, wherein at least one gap forms a first stacking level for receiving a complementary foot of an upper stacked tray when said upper stacked tray is oriented in an angular position rotated 180 degrees relative to a lower tray.

9. The tray of claim 8 further comprising a second stacked level formed by recesses between adjacent portions of the discontinuous inner ledge for receiving a complementary foot of an upper stacked tray when said upper stacked tray is oriented identical to the lower tray.

10. The tray of claim 9, wherein the first stacking level is lower than the second stacking level.

11. The tray of claim 10 further comprising blind stacking and unstacking means for sliding engagement of the inner groove of the feet of an upper tray with respect to the discontinuous inner ledge of a lower tray for stacking the upper and lower trays vertically when in at least one of an identical angular orientation and an angular orientation rotated 180° with respect to one another.

12. The tray of claim 1 further comprising each side wall having at least a pair of shelves extending outwardly from the side wall and defining a horizontal stop when the tray is stacked in an angular position rotated 180° with respect to another tray.

13. The tray of claim 1 further comprising each foot having only vertical and horizontal edges.

14. A tray for stacking a plurality of identical trays with respect to one another and providing at least three levels of stacking corresponding to different angular positions of adjacent vertically stacked trays with respect to one another, said tray comprising:

a front wall having a pair of angular surfaces adjacent each end and a lower surface therebetween, wherein said lower surface of the front wall supports stacked trays when rotated 90° with respect to one another;

a rear wall opposite from the front wall;

two side walls opposite from one another and connected to the front wall and rear wall at vertically extending corners, the two side walls being mirror images of each other, each side wall having a continuous outer ledge at an upper end of each side wall and a discontinuous inner ledge spaced from the outer ledge forming a discontinuous groove therebetween, the rear wall meeting each side wall at one of the corners with downwardly directed flanges proximate to each corner, the downwardly directed flanges preventing movement of stacked trays when rotated 90° relative to one another, each side wall having at least a pair of shelves extending outwardly from the side wall defining a horizontal stop for stacked trays when rotated 180° with respect to one another;

a rectangular floor integrally connected to the four walls;

a plurality of non-uniformly spaced feet formed at a lower end on each side wall providing different stacking levels when two identical trays are stacked vertically at different angular orientations with respect to one another, wherein a first level of stacking is defined when vertically adjacent stacked trays are aligned in an identical orientation with respect to one another, a second level of stacking is defined when vertically adjacent stacked trays are rotated 90° with respect to one another, and a third level of stacking is defined when vertically adjacent stacked trays are rotated 180° with respect to one another, the plurality of feet along each side wall having different horizontal lengths and spaced along each side wall at uneven intervals, each foot having only vertical and horizontal edges defining an inner groove for sliding over the discontinuous inner ledge;

a notch in each of said front and rear walls adjacent to each side wall in vertical alignment with the feet and in horizontal alignment with the discontinuous groove providing sliding access to the discontinuous groove by the feet of another tray for blind stacking and unstacking, the notch formed as a generally concave indentation with steep opposing sides; and at least one handle in each side wall formed by gaps between portions of the discontinuous inner ledge, at least one gap forming a first stacking level for receiving a complementary foot of an upper stacked tray when said upper stacked tray is oriented 180° relative to a lower tray, a second stacked level formed by recesses between adjacent portions of the discontinuous inner ledge for receiving a complementary foot of an upper stacked tray when said upper stacked tray is oriented identical to the lower tray, the first stacking level being lower than the second stacking level, the feet integrally formed on lower ends of each side wall of the upper tray and a corresponding number of shaped slots formed in upper ends of each side wall of the lower tray and engageable with respect to the corresponding feet for defining cam surfaces engageable with one another to move the upper tray in a direction toward one of the front and rear walls in response to the one wall being lifted to allow the upper tray to slide with respect to the lower tray for unstacking the upper tray from the lower tray when the upper and lower trays are in one of the first and third levels of stacking.

15. A tray for stacking a plurality of identical trays with respect to one another and providing at least three levels of stacking corresponding to different angular positions of vertically adjacent stacked trays with respect to one another, said tray comprising:

a front wall;

a rear wall opposite from the front wall;

two side walls and a rectangular floor integrally connected to the four walls, wherein said two side walls are mirror images of each other;

means for sliding an aligned upper stacked tray with respect to a lower stacked tray between a stacked position and an unstacked position, wherein a first stacked position is defined when adjacent stacked trays are aligned in an identical orientation with respect to one another, a second stacked position is defined when adjacent stacked trays are rotated 90° with respect to one another, and a third stacked position is defined when adjacent stacked trays are rotated 180° with respect to one another;

means for preventing movement of the upper tray with respect to the lower tray when in one of the stacked positions; and means for pivoting the upper tray when in one of the first and third stacked positions for releasing the movement preventing means and for allowing sliding movement of the upper tray with respect to the lower tray.

16. The tray of claim 15 wherein the pivoting means further comprises:

at least two feet integrally formed on lower ends of each side wall of the upper tray; and a corresponding number of shaped slots formed in upper ends of each side wall of the lower tray and engageable with respect to the corresponding feet for defining cam surfaces engageable with one another to move the upper tray toward one of the front and rear walls in response to the one wall being lifted to allow the upper tray to slide with respect to the lower tray for unstacking the upper tray from the lower tray when the upper and lower trays are in one of the first and third stacked positions.

17. The tray of claim 15 further comprising:

an elongate discontinuous rail extending along each side wall of the lower tray;

a pair of first notches in each of the front and rear walls, each notch vertically and horizontally, coaxially aligned with one of the corresponding rails extending along an adjacent side wall, the first pair of notches aligning the upper tray with respect to the lower tray for sliding movement along the rail when moving with respect to one of the first and third stacked positions; and a pair of second notches in each of the front and rear walls spaced inwardly from the side walls further than the pair of first notches.

18. The tray of claim 15 wherein the sliding means further comprises:

at least two feet integrally formed on lower ends of each side of the upper tray; and an elongate discontinuous groove extending along each side wall for receiving the corresponding feet in sliding engagement therewith.

19. The tray of claim 15 wherein the movement preventing means further comprises:

at least two feet integrally formed on lower ends of each side wall of the upper tray; and at least two shaped slots located on upper ends of each side wall for receiving the corresponding feet when in one of the first and third stacked positions for preventing unintended movement of the upper tray with respect to the lower tray.

20. The tray of claim 15 further comprising:

at least one shelf located on each side walls of the upper tray for resting on a portion of the lower tray; and a rail lip on each side wall of the lower tray engageable with the corresponding shelf and acting as a vertical stop between the upper tray with respect to the lower tray.

* * * * *